US005538601A

United States Patent [19]

Castegnier

[11] Patent Number: 5,538,601

[45] Date of Patent: Jul. 23, 1996

[54] ELECTROCOAGULATION PRINTING AND APPARATUS

[75] Inventor: Adrien Castegnier, Outremont, Canada

[73] Assignee: Elcorsy Inc., Saint-Laurent, Canada

[21] Appl. No.: 527,866

[22] Filed: Sep. 14, 1995

[51] Int. Cl.[6] ..... B41L 19/00

[52] U.S. Cl. ..... 204/486; 204/495; 204/508; 204/623; 204/624; 101/DIG. 29

[58] Field of Search ..... 204/300 EC, 300 PE, 204/299 EC, 300 R, 180.2, 180.4, 180.9, 181.1; 101/DIG. 29

[56] References Cited

U.S. PATENT DOCUMENTS

| | | | |
|---|---|---|---|
| 2,267,901 | 12/1941 | Duncan | 101/DIG. 29 X |
| 2,486,985 | 11/1949 | Ruderfer | 101/DIG. 29 X |
| 2,530,956 | 11/1950 | Gibney | 101/DIG. 29 X |
| 3,145,156 | 8/1964 | Oster | 204/299 PE X |
| 3,179,045 | 4/1965 | Evers | 101/181 |
| 3,409,528 | 11/1968 | Lennon | 204/299 EC X |
| 3,471,387 | 10/1969 | Lennon et al. | 204/299 EC X |
| 3,892,645 | 7/1975 | Castegnier | 204/299 |
| 4,115,234 | 9/1978 | Anselrode | 204/299 EC X |
| 4,555,320 | 11/1985 | Castegnier | 204/180.9 |
| 4,586,434 | 5/1986 | Tokuno et al. | 101/178 |
| 4,661,222 | 4/1987 | Castegnier | 204/180.9 |
| 4,895,629 | 1/1990 | Castegnier | 204/180.9 |
| 4,909,148 | 3/1990 | George | 101/178 |
| 5,009,157 | 4/1991 | Rogge et al. | 101/178 |

*Primary Examiner*—John Niebling
*Assistant Examiner*—John S. Starsiak, Jr.
*Attorney, Agent, or Firm*—Swabey Ogilvy Renault

[57] ABSTRACT

A polychromic image is reproduced and transferred onto a substrate by (a) providing a single positive electrode formed of an electrolytically inert metal and having a continuous passivated surface moving at substantially constant speed along a predetermined path, the passivated surface defining a positive electrode active surface; (b) forming on the positive electrode active surface a plurality of dots of colored, coagulated colloid by electrocoagulation of an electrolytically coagulable colloid in the presence of a coloring agent, the dots of colored, coagulated colloid being representative of a desired image; and (c) bringing a substrate into contact with the dots of colored coagulated colloid image to cause transfer of the colored, coagulated colloid from the positive electrode active surface onto the substrate and thereby imprint the substrate with the image. Steps (b) and (c) are repeated several times to define a corresponding number of printing stages arranged at predetermined locations along the aforesaid path and each using a coloring agent of different color, and to thereby produce several differently colored images of coagulated colloid which are transferred at respective transfer positions onto the substrate in superimposed relation to provide the desired polychromic image.

49 Claims, 4 Drawing Sheets

ELECTROCOAGULATION PRINTING AND APPARATUS

BACKGROUND OF THE INVENTION

The present invention pertains to improvements in the field of dynamic printing. More particularly, the invention relates to an improved multicolor electrocoagulation printing method and apparatus.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The dispersion containing the olefinic substance and the metal oxide is applied onto the surface of the positive electrode in a manner so as to form on the electrode surface micro-droplets of olefinic substance containing the metal oxide. As described in the aforementioned patent, this may be achieved by means of a device comprising a rotatable brush provided with a plurality of radially extending horsehair bristles having extremities contacting the electrode surface, and a distribution roller arranged in spaced-apart parallel relation to the brush such as to contact the bristles thereof at their extremities. The distribution roller has a plurality of peripheral longitudinally extending grooves and is partially immersed in a bath containing the dispersion. As the distribution roller rotates in the dispersion, the grooves are filled with the dispersion which is thus transferred to the bristles to coat the extremities thereof. Rotation of the brush, on the other hand, causes the coated bristles to transfer the dispersion onto the surface of the positive electrode and thereby form the desired micro-droplets of olefinic substance containing the metal oxide. Instead of a brush, use can be made of a roller provided with a plurality of radially extending strips of chamois leather adapted to contact the electrode surface, the strips being coated in the same manner as the bristles. Rotation of such a roller causes the coated strips to impinge upon the surface of the positive electrode such as to transfer thereon the dispersion and thereby form the desired micro-droplets of olefinic substance containing the metal oxide.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where a pigment is used, a dispersing agent is added for uniformly dispersing the pigment into the ink.

When a polychromic image is desired, the negative and positive electrodes, the positive electrode coating device and the ink injector are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

Since each printing unit of the above multicolor printing apparatus requires a high precision cylinder which is usually in stainless steel, as a positive electrode, such an apparatus is not only cumbersome but also very costly. Moreover, as several high precision cylinders are required for forming differently colored images of coagulated colloid, it is difficult to provide a polychromic image in which the differently colored images are perfectly superimposed.

SUMMARY OF THE INVENTION

It is therefore an object of the present invention to overcome the above drawbacks and to provide an improved multicolor electrocoagulation printing method and apparatus of reduced cost and cumbersomeness, capable of providing a polychromic image of high definition.

According to one aspect of the invention, there is provided a multicolor electrocoagulation printing method comprising the steps of:

a) providing a single positive electrode formed of an electrolytically inert metal and having a continuous passivated surface moving at substantially constant speed along a predetermined path, the passivated surface defining a positive electrode active surface;

b) forming on the positive electrode active surface a plurality of dots of colored, coagulated colloid by electrocoagulation of an electrolytically coagulable colloid in the presence of a coloring agent, the dots of colored, coagulated colloid being representative of a desired image;

c) bringing a substrate into contact with the dots of colored, coagulated colloid to cause transfer of the colored, coagulated colloid from the positive electrode active surface onto the substrate and thereby imprint the substrate with the image; and d) repeating steps (b) and (c) several times to define a corresponding number of printing stages arranged at predetermined locations along the aforesaid path and each using a coloring agent of different color, and to thereby produce several differently colored images of coagulated colloid which are transferred at respective transfer positions onto the substrate in superimposed relation to provide a polychromic image.

The present invention also provides, in a further aspect thereof, an apparatus for carrying out a method as defined above. The apparatus of the invention comprises:

a single positive electrode formed of an electrolytically inert metal and having a continuous passivated surface defining a positive electrode active surface;

means for moving the positive electrode active surface at a substantially constant speed along a predetermined path; and a plurality of printing units arranged at predetermined locations along the path, each printing unit comprising:

means for forming on the positive electrode active surface a plurality of dots of colored, coagulated colloid by electrocoagulation of an electrolytically coagulable colloid in the presence of a coloring agent of different color, the dots of colored, coagulated colloid being representative of a desired image; and means for bringing a substrate into contact with the dots of colored, coagulated colloid at a respective transfer station to cause transfer of the colored, coagulated colloid from the positive electrode active surface onto the substrate and thereby imprint the substrate with the image;

whereby to produce several differently colored images of coagulated colloid which are transferred at the respective transfer stations onto the substrate in superimposed relation to provide a polychromic image.

In contrast to conventional dynamic and static printing methods and apparatuses where a central impression cylinder is used to convey a web to planetary printing units for impression by respective plate cylinders, the electrocoagulation printing method and apparatus of the invention utilize a single positive electrode on which dots of colored, coagulated colloid are formed in sequence and the substrate which is generally in the form of a web travels independently of the positive electrode, from one printing unit to another, so as to contact the colored, coagulated colloid in sequence. The invention enables one to significantly improve the registration of the differently colored images upon their transfer onto the web or other substrate, thereby providing a polychromic image of high definition.

The essence of the invention is of course not limited to electrocoagulation printing, but also extends to other dynamic printing techniques, such as xerography, ionography and magnetography.

According to a broad aspect of the invention, there is thus provided a multicolor dynamic printing method comprising the steps of:

a) providing a single support member having a continuous surface moving at substantially constant speed along a predetermined path;

b) forming on the surface a colored image with a printing ink containing a coloring agent;

c) bringing a substrate into contact with the colored image to cause transfer of the image from the surface onto the substrate and thereby imprint the substrate with the image; and d) repeating steps (b) and (c) several times to define a corresponding number of printing stages arranged at predetermined locations along the aforesaid path and each using a coloring agent of different color, and to thereby produce several differently colored images which are transferred at respective transfer positions onto the substrate in superimposed relation to provide a polychromic image.

According to yet another broad aspect of the invention, there is provided a multicolor dynamic printing apparatus comprising:

a single support member having a continuous surface;

means for moving the surface at a substantially constant speed along a predetermined path; and a plurality of printing units arranged at predetermined locations along the path, each printing unit comprising:

means for forming on the surface a colored image with a printing ink containing a coloring agent of different color; and means for bringing a substrate into contact with the colored image at a respective transfer station to cause transfer of the image from the surface onto the substrate and thereby imprint the substrate with the image;

whereby to produce several differently colored images which are transferred at the respective transfer stations onto the substrate in superimposed relation to provide a polychromic image.

Where the desired image is reproduced by electrocoagulation of a colloid, the positive electrode used can be in the form of a moving endless belt as described in Applicant's U.S. Pat. No. 4,661,222, or in the form of a revolving cylinder as described in the aforementioned U.S. Pat. No. 4,895,629, the teachings of which are incorporated herein by reference. In later case, the printing units are arranged around the positive cylindrical electrode.

When use is made of a positive electrode of cylindrical configuration rotating at substantially constant speed about its central longitudinal axis, step (b) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) coating the positive electrode active surface with an olefinic substance and a metal oxide to form on the surface micro-droplets of olefinic substance containing the metal oxide;

iii) filling the electrode gap with a substantially liquid colloidal dispersion containing the electrolytically coagulable colloid, the coloring agent, a liquid dispersing medium and a soluble electrolyte;

iv) electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming the dots of colored, coagulated colloid; and v) removing any remaining non-coagulated colloid from the positive electrode active surface.

As explained in U.S. Pat. No. 4,895,629, spacing of the negative electrodes from one another by a distance which is equal to or greater than the electrode gap prevents the negative electrodes from undergoing edge corrosion. On the other hand, coating of the positive electrode with an olefinic substance and a metal oxide prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, platinum, chromium, nickel and aluminum. The positive electrode is preferably made of stainless steel or aluminum so that upon electrical energization of the negative electrodes, dissolution of the passive oxide film on such an electrode generates trivalent ions which then initiate coagulation of the colloid.

The gap which is defined between the positive and negative electrodes can range from about 50μ to about 100μ, the smaller the electrode gap the sharper are the dots of coagulated colloid produced. Where the electrode gap is of the order of 50μ, the negative electrodes are the preferably spaced from one another by a distance of about 75μ.

Examples of suitable olefinic substances which may be used to coat the surface of the positive electrode include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. The olefinic substance is advantageously applied onto the positive electrode active surface in the form of an oily dispersion containing the metal oxide as dispersed phase. Examples of suitable metal oxides include aluminum oxide, ceric oxide, chromium oxide, cupric oxide, magnesium oxide, manganese oxide, titanium dioxide and zinc oxide; chromium oxide is the preferred metal oxide. Depending on the type of metal oxide used, the amount of metal oxide may range from about 20 to about 60% by weight, based on the total weight of the dispersion. Preferably, the olefinic substance and the metal oxide are present in the dispersion in substantially equal amounts. A particularly preferred dispersion contains about 50 wt. % of oleic acid or linoleic acid and about 50 wt. % of chromium oxide.

The oily dispersion containing the olefinic substance and the metal oxide is advantageously applied onto the positive electrode active surface by providing a distribution roller extending parallel to the positive cylindrical electrode and having a peripheral coating comprising an oxide ceramic material, applying the oily dispersion onto the ceramic coating to form on a surface thereof a film of the oily dispersion uniformly covering the surface of the ceramic coating, the film of oily dispersion breaking down into micro-droplets containing the olefinic substance in admixture with the metal oxide and having substantially uniform size and distribution, and transferring the micro-droplets from the ceramic coating onto the positive electrode active surface. As explained in Applicant's copending U.S. patent application Ser. No. 08/185,528 filed Jan. 24, 1994, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the metal oxide and having substantially uniform size and distribution. The micro-droplets formed on the surface of the ceramic coating and transferred onto the positive electrode active surface generally have a size ranging from about 1 to about 5μ.

A particularly preferred oxide ceramic material forming the aforesaid ceramic coating comprises a fused mixture alumina and titania. Such a mixture may comprise about 60 to about 90 weight % of alumina and about 10 to about 40 weight % of titania.

According to a preferred embodiment of the invention, the oily dispersion is applied onto the ceramic coating by disposing an applicator roller parallel to the distribution roller and in pressure contact engagement therewith to form a first nip, and rotating the applicator roller and the distribution roller in register while feeding the oily dispersion into the first nip, whereby the oily dispersion upon passing through the first nip forms a film uniformly covering the surface of the ceramic coating. The micro-droplets are advantageously transferred from the distribution roller to the positive electrode by disposing a transfer roller parallel to the distribution roller and in contact engagement therewith to form a second nip, positioning the transfer roller in pressure contact engagement with the positive electrode to form a third nip, and rotating the transfer roller and the positive electrode in register for transferring the micro-droplets from the distribution roller to the transfer roller at the second nip and thereafter transferring the micro-droplets from the transfer roller to the positive electrode at the third nip.

Preferably, the applicator roller and the transfer roller are each provided with a peripheral covering of a resilient material which is resistant to attack by the olefinic substance, such as a synthetic rubber material. For example, use can be made of a polyurethane having a Shore A hardness of about 50 to about 70 in the case of the applicator roller, or a Shore A hardness of about 60 to about 80 in the case of the transfer roller.

In some instances, depending on the type of olefinic substance used, Applicant has noted that the film of oily dispersion only partially breaks down on the surface of the ceramic coating into the desired micro-droplets. Thus, in order to ensure that the film of oily dispersion substantially completely breaks on the ceramic coating into micro-droplets of olefinic substance containing the metal oxide and having substantially uniform size and distribution, step (b)(ii) of the electrocoagulation printing method of the invention is preferably carried out by providing first and second distribution rollers extending parallel to the positive cylindrical electrode and each having a peripheral coating comprising an oxide ceramic material, applying the oily dispersion onto the ceramic coating of the first distribution roller to form on a surface thereof a film of the oily dispersion uniformly covering the surface of the ceramic coating, the film of oily dispersion at least partially breaking down into micro-droplets containing the olefinic substance in admixture with the metal oxide and having substantially uniform size and distribution, transferring the at least partially broken film from the first distribution roller to the second distribution roller so as to cause the film to substantially completely break on the ceramic coating of the second distribution roller into the desired micro-droplets having substantially uniform size and distribution, and transferring the micro-droplets from the ceramic coating of the second distribution roller onto the positive electrode active surface. Preferably, the ceramic coatings of the first distribution roller and the second distribution roller comprise the same oxide ceramic material.

According to a preferred embodiment, the oily dispersion is applied onto the ceramic coating of the first distribution roller by disposing an applicator roller parallel to the first distribution roller and in pressure contact engagement therewith to form a first nip, and rotating the applicator roller and the first distribution roller in register while feeding the oily dispersion into the first nip, whereby the oily dispersion upon passing through the first nip forms a film uniformly covering the surface of the ceramic coating.

According to another preferred embodiment, the at least partially broken film of oily dispersion is transferred from the first distribution roller to the second distribution roller and the micro-droplets are transferred from the second distribution roller to the positive electrode by disposing a first transfer roller between the first distribution roller and the second distribution roller in parallel relation thereto, positioning the first transfer roller in pressure contact engagement with the first distribution roller to form a second nip and in contact engagement with the second distribution roller to form a third nip, rotating the first distribution roller and the first transfer roller in register for transferring the at least partially broken film from the first distribution roller to the first transfer roller at the second nip, disposing a second transfer roller parallel to the second distribution roller and in pressure contact engagement therewith to form a fourth nip, positioning the second transfer roller in pressure contact engagement with the positive electrode to form a fifth nip, and rotating the second distribution roller, the second transfer roller and the positive electrode in register for transferring the at least partially broken film from the first transfer roller to the second distribution roller at the third nip, then transferring the micro-droplets from the second distribution roller to the second transfer roller at the fourth nip and thereafter transferring the micro-droplets from the second transfer roller to the positive electrode at the fifth nip.

Where the positive cylindrical electrode extends vertically, step (b)(iii) of the above electrocoagulation printing method is advantageously carried out by continuously discharging the colloidal dispersion onto the positive electrode active surface from a fluid discharge means disposed adjacent the electrode gap at a predetermined height relative to the positive electrode and allowing the colloidal dispersion to flow downwardly along the positive electrode active surface, the colloidal dispersion being thus carried by the positive electrode upon rotation thereof to the electrode gap to fill same. Preferably, excess colloidal dispersion flowing downwardly off the positive electrode active surface is collected and the collected colloidal dispersion is recirculated back to the fluid discharge means.

The colloid generally used is a linear colloid of high molecular weight, that is, one having a molecular weight comprised between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a molecular weight of about 250,000 and sold by Cyanamid Inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The colloidal dispersion also contains a soluble electrolyte and a coloring agent. Preferred electrolytes include alkali metal halides and alkaline earth metal halides, such as lithium chloride, sodium chloride, potassium chloride and calcium chloride. The electrolyte is preferably used in an amount of about 6.5 to about 9% by weight, based on the total weight of the dispersion. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the dispersion. Examples of suitable dispersing agents include the non-ionic dispersing agent sold by ICI Canada Inc. under the trade mark SOLSPERSE 27000. The pigment is preferably used in an amount of about 6.5 to about 12% by weight, and the dispersing agent in an amount of about 0.4 to about 6% by weight, based on the total weight of the dispersion.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected colloidal dispersion, and the collected colloidal dispersion in admixture with the collected non-coagulated colloid is recirculated back to the aforesaid fluid discharge means.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
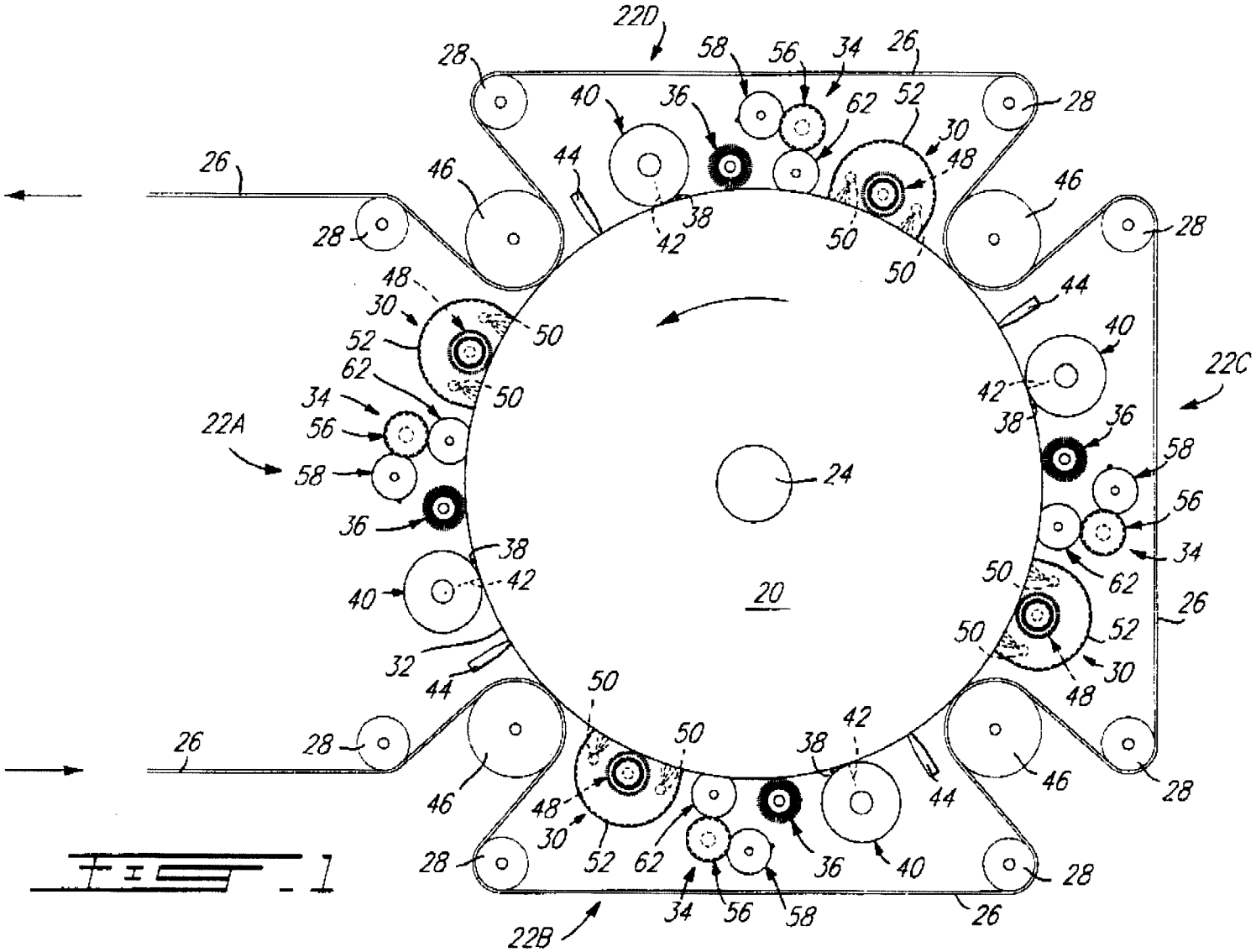
FIG. 1 is a schematic top plan view of a multicolor electrocoagulation printing apparatus according to a preferred embodiment of the invention, comprising four printing stations each using a coloring agent of different color.

Referring first to FIG. 1, there is illustrated a multicolor electrocoagulation printing apparatus comprising a central positive electrode 20 in the form of a revolving cylinder and four identical printing units 22 arranged around the cylindrical electrode 20. In the embodiment shown, the first printing unit 22A at the left of the figure is adapted to print in yellow color, the second printing unit 22B in magenta color, the third printing unit 22C in cyan color and the fourth printing unit 22D in black color. The cylindrical electrode 20 extends vertically and has a shaft 24 which is driven by a motor (not shown) for rotating the electrode about a vertical axis coincident with the shaft 24. A substrate in the form of a continuous web 26 is fed to the printing units for being imprinted with differently colored images which are transferred at respective transfer stations onto the web in superimposed relation to provide a polychromic image, the web 26 being guided to the respective transfer stations by guide rollers 28.

Figure 2:
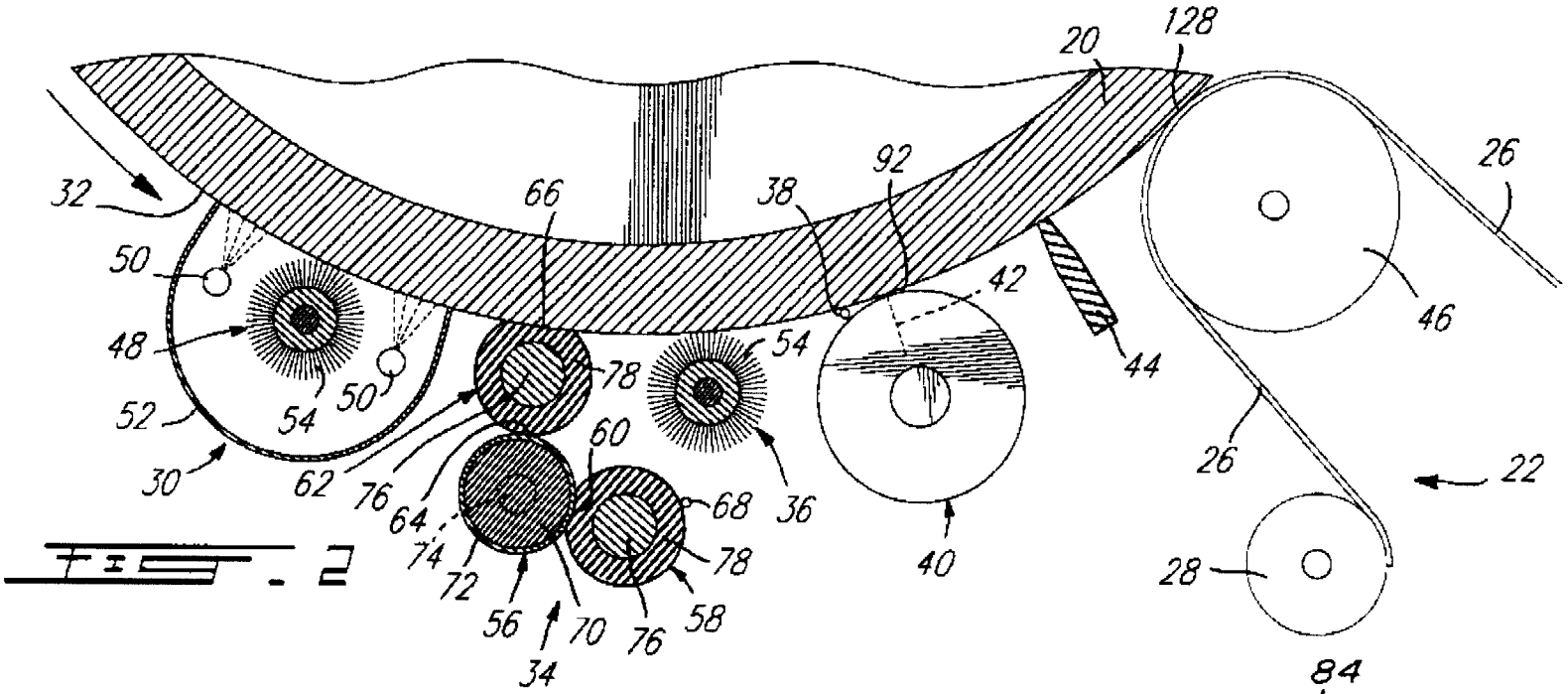
FIG. 2 is a fragmentary sectional view thereof, showing one of the printing stations.

As best shown in FIG. 2, the printing units 22 each comprise a cleaning device 30 for cleaning the surface 32 of the positive electrode 20, a positive electrode coating device 34 for coating the surface 32 with an olefinic substance and a metal oxide, a polishing brush 36 for polishing the olefin and metal oxide-coated surface 32, a device 38 for discharging a colloid onto the surface 32, a printing head 40 provided with negative electrodes 42 for electrocoagulating the colloid to form on the positive electrode surface 32 dots of colored, coagulated colloid representative of a desired image and a soft rubber squeegee 44 for removing any remaining non-coagulated colloid from the surface 32. Each printing unit 22 further includes a pressure roller 46 for bringing the web 26 into contact with the dots of colored, coagulated colloid to cause transfer of the colored, coagulated colloid onto the web 26 and thereby imprint the web with the image. As shown in FIG. 1, the provision of two pairs of diametrically opposed pressure rollers 46 arranged about the cylindrical electrode 20 prevents the electrode 20 from flexing since the forces exerted by the rollers 46 of each pair cancel each other out.

The positive electrode cleaning devices 30 each comprise a rotating brush 48 and two high pressure water injectors 50 arranged in a housing 52. Each brush 48 is provided with a plurality of radially extending bristles 54 made of horsehair and having extremities contacting the surface 32. Any coagulated colloid remaining on the surface 32 after transfer of the dots of colored, coagulated colloid at the transfer station of a preceding printing unit is thus removed by the brush 48 and washed away by the powerful jets of water produced by the injectors 50.

The positive electrode coating devices 34 each comprise a vertically extending distribution roller 56, an applicator roller 58 extending parallel to the distribution roller 56 and in pressure contact engagement therewith to form a nip 60, and a transfer roller 62 extending parallel to the roller 56 and in contact engagement therewith to form a nip 64. The transfer roller 62 is in pressure contact engagement with the positive electrode 20 to form a nip 66 and permit the roller 62 to be driven by the positive electrode 20 upon rotation thereof. Each coating device 34 further includes a feeding device 68 for supplying to the applicator roller 58 the olefinic substance in the form of an oily dispersion containing the metal oxide as dispersed phase.

The distribution roller 56 has a solid core 70 of metal provided with a peripheral coating 72 of oxide ceramic material. A pair of stub shafts 74 (only one shown) integral with the core 70 extends outwardly from the extremities of the roller 56. The applicator roller 58 and transfer roller 62 also have a solid core 76 of metal, but are provided with a peripheral covering 78 of polyurethane. The rollers 56 and 58 are rotated in register by means of a motor (not shown) driving the shaft 74 of the distribution roller 56. The drive from the motor rotates the distribution roller 56 in a counterclockwise manner, which in turn transmits a clockwise rotation to the applicator roller 58.

The feeding device 68 is adapted to discharge the oily dispersion onto the applicator roller 58 at an upper portion thereof. The dispersion then flows downwardly under gravity along the roller 58 and is carried to the nip 60 by the roller 58 during rotation thereof. The dispersion upon passing through the nip 60 forms a film uniformly covering the surface of the ceramic coating 70 of the distribution roller 56, the film breaking down into micro-droplets containing the olefinic substance in admixture with the metal oxide and having substantially uniform size and distribution. The micro-droplets formed on the roller 56 are carried by the latter to the nip 64 where they are transferred onto the transfer roller 62. The micro-droplets are then carried by the roller 62 to the nip 66 where they are transferred onto the positive electrode 20.

Figure 3:
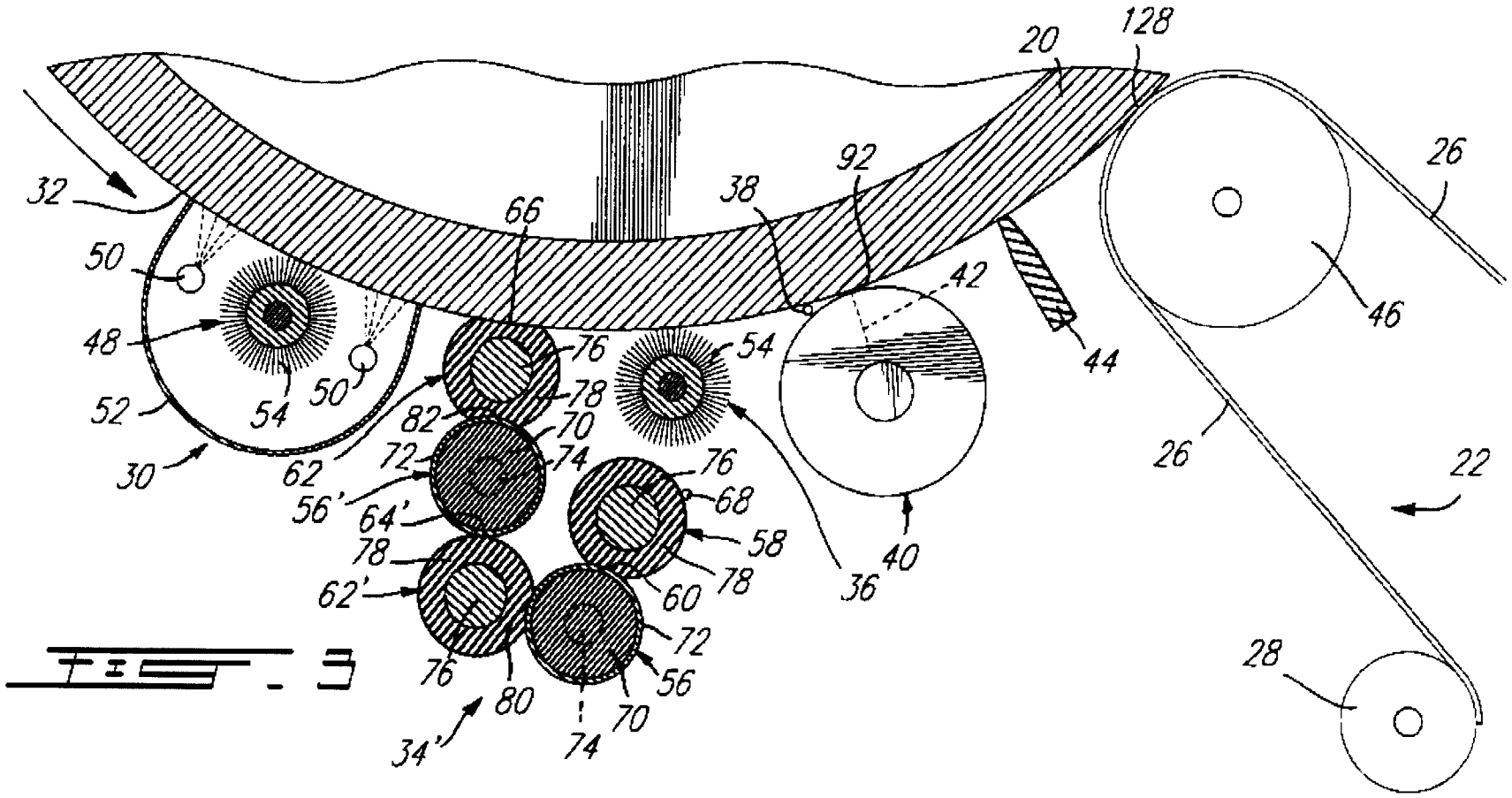
FIG. 3 is a view similar to FIG. 2, but showing a different embodiment.

The positive electrode coating device 34' illustrated in FIG. 3 is similar to the device 34 shown in FIG. 2, except there are two distribution rollers 56 and 56' with an additional transfer roller 62' arranged therebetween. Such an arrangement ensures that the film of oily dispersion formed on the distribution roller 56 substantially completely breaks down into the desired micro-droplets prior to transfer onto the positive electrode 20, should the film only partially break down on the surface of the ceramic coating 72 of the distribution roller 56. As shown, the transfer roller 62' extends parallel to the distribution rollers 56 and 56' and in pressure contact engagement with the roller 56 to form a nip 80 and permit the roller 62' to be driven by the distribution roller 56 upon rotation thereof, the transfer roller 62' being in contact engagement with the distribution roller 56' to form a nip 64'. The distribution roller 56, applicator roller 58 and transfer roller 62' thus rotate in register. The second distribution roller 56', on the other hand, is in pressure contact engagement with the transfer roller 62 to form a nip 82 and permit the roller 56' to be driven by the transfer roller 62 upon rotation thereof. The distribution roller 56', transfer roller 62 and positive electrode 20 thus rotate in register. Any partially broken film of oily dispersion formed on the surface of the ceramic coating 72 of the distribution roller 56 is transferred from the roller 56 to the transfer roller 62' at the nip 80 and thereafter transferred from the roller 62' to the distribution roller 56' at the nip 64', the film substantially completely breaking down on the surface of the ceramic coating 72 of the roller 56' into the desired micro-droplets having substantially uniform size and distribution. The micro-droplets of olefinic substance containing the metal oxide are then transferred from the roller 56' to the transfer roller 62 at the nip 82 and thereafter transferred from the roller 62 to the positive electrode 20 at the nip 66.

The polishing brushes 36 used for polishing the olefin and metal oxide-coated surface 32 of the positive electrode 20 are similar to the brushes 48, each brush 36 being provided with a plurality of radially extending bristles 54 made of horsehair and having extremities contacting the surface 32. The friction caused by the bristles 54 contacting the surface 32 upon rotation of the brush 36 has been found to increase the adherence of the micro-droplets onto the positive electrode surface 32.

Figure 4:
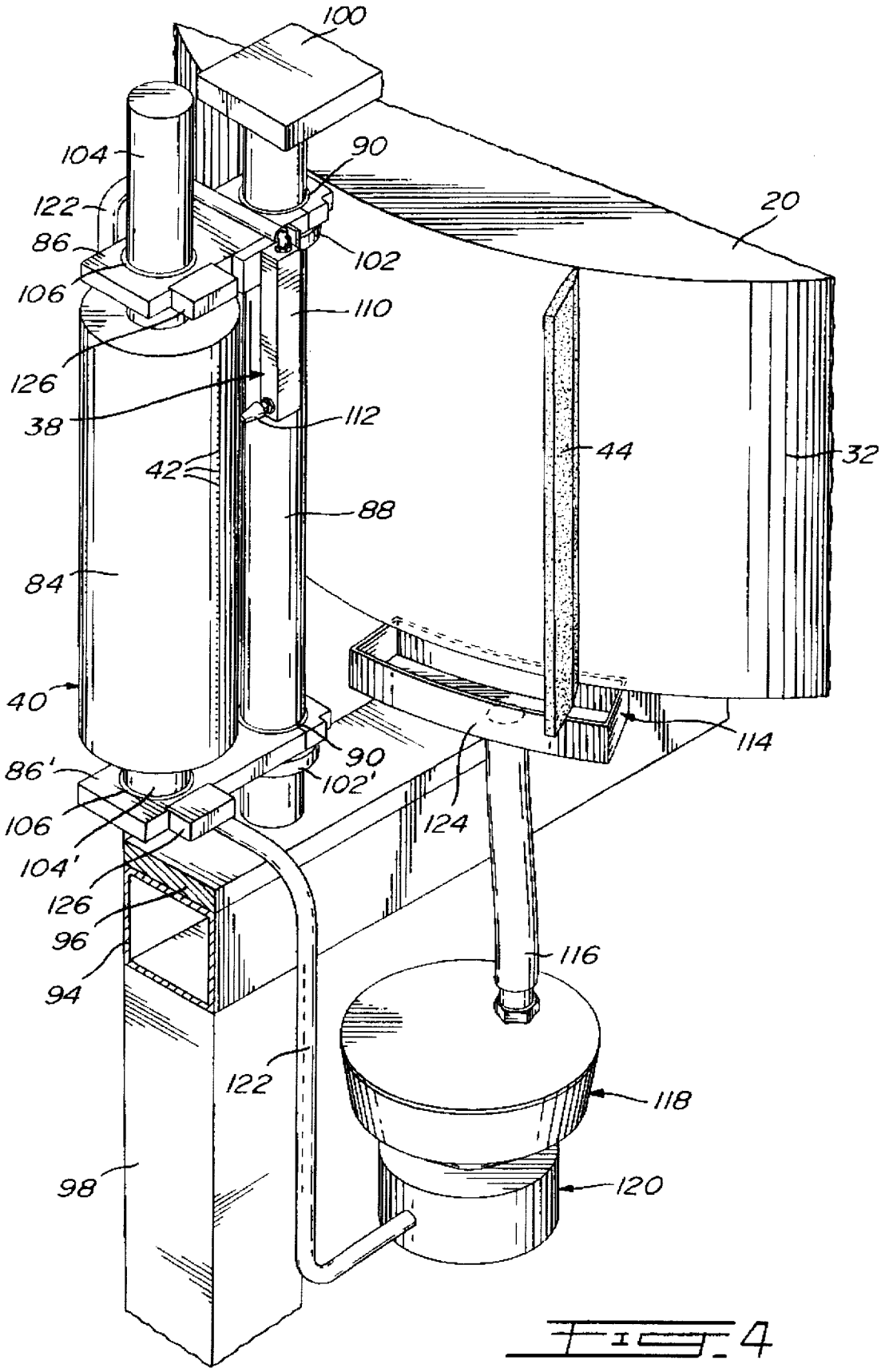
FIG. 4 is a fragmentary perspective view of the apparatus illustrated in FIG. 1, showing one of the printing heads used for electrocoagulation of the colloid.

As shown in FIG. 4, each printing head 40 comprises a cylindrical body 84 mounted between a pair of upper and lower arms 86,86' which are pivotally connected to a column 88 with bushings 90, for pivotal movement of the printing head 40 between an operative position (shown in FIGS. 1, 2 and 3) whereat the negative electrodes 42 are spaced from the positive electrode 20 by a constant predetermined gap 92 and a cleaning position (shown in FIG. 4) whereat the negative electrodes 42 are exposed to permit cleaning thereof. The column 88 is mounted on a horizontal beam 94 provided with a metal reinforcing member 96, the beam 94 being supported at a predetermined height by a plurality of vertical beams 98 (only one shown). The column 88 is fixed at its upper end to an attachment arm 100 which is connected to the shaft 24 of the electrode 20. A pair of collars 102,102' fixed to the column 88 support the upper and lower arms 86 and 86', respectively. The printing head 40 includes a pair of stub shafts 104,104' extending through the arms 86 and 86', respectively, bushings 106 being provided to enable the body 84 to be rotated about a vertical axis coincident with the shafts 104,104' and thereby permitting a greater access to the negative electrodes 42 for cleaning same. A releasable locking mechanism (not shown) is provided to secure the body 84 in the desired position.

Figure 5:
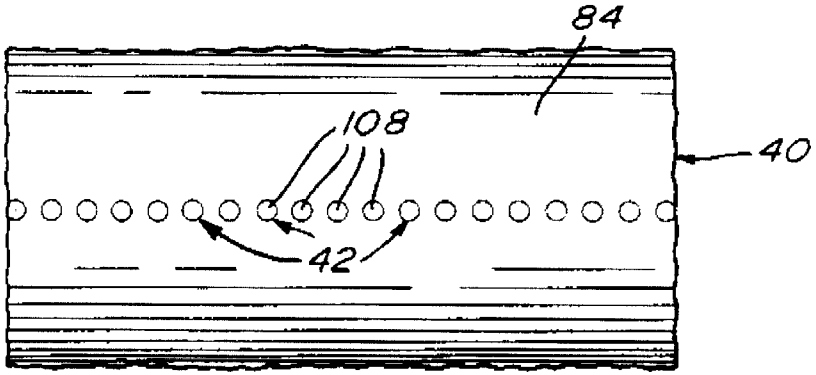
FIG. 5 which is on the same sheet of drawings as FIG. 2 is a fragmentary longitudinal view of the printing head illustrated in FIG. 4.

The negative electrodes 42 of each printing head 40 are electrically insulated from one another and arranged in rectilinear alignment along the length of the body 84 to define a series of corresponding negative electrode active surfaces 108, as best shown in FIG. 5. In the operative position, the printing head 40 is positioned relative to the positive electrode 20 such that the surfaces 108 of the negative electrodes 42 are disposed in a plane parallel to the central longitudinal axis of the electrode 20 and are spaced from the positive electrode surface 32 by the gap 92. The electrodes 42 are also spaced from one another by a distance at least equal to the electrode gap 92 to prevent edge corrosion of the negative electrodes.

The device 38 which is used to fill the electrode gap 92 with a colloidal dispersion containing an electrolytically coagulable colloid, a dispersing medium, a soluble electrolyte and a coloring agent comprises an elongated hollow body 110 defining a container for receiving the colloidal dispersion and a fluid discharge nozzle 112 at the lower end of the body 110 for continuously discharging the dispersion onto the positive electrode surface 32. The body 110 is fixed to the upper arm 86 such that when the printing head 40 is in the working position, the nozzle 112 is disposed adjacent the electrode gap 92 at a predetermined height relative to the positive electrode 20. As the colloidal dispersion is being discharged from the nozzle 112 onto the positive electrode surface 32, it flows downwardly along the surface 32 and is carried by the positive electrode 30 upon rotation thereof to the electrode gap 92 to fill same. Excess colloidal dispersion flowing downwardly off the surface 32 is collected in a trough 114 which is connected by conduit 116 to a reservoir 118. A recirculation pump 120 is connected to the reservoir 118 for recirculating the collected dispersion back to the device 38 through conduit 122. The trough 114 has an arcuate outer wall 124 adapted to be contacted by a stop member 126 fixed to the lower arm 86' when the printing head is moved to the operative position, for providing the desired electrode gap 92. A similar stop member 126 is fixed to the upper arm 86 for contact engagement with an abutment member (not shown) disposed above the electrode 20.

Electrical energizing of selected ones of the negative electrodes 42 causes point-by-point selective coagulation and adherence of the colloid onto the olefin and metal oxide-coated surface 32 of the positive electrode 20 opposite the electrode active surfaces 108 of the energized negative electrodes 42 while the electrode 20 is rotating, thereby forming a series of corresponding dots of colored, coagulated colloid representative of a desired image. After electrocoagulation of the colloid, any remaining non-coagulated colloid is removed from the positive electrode surface 32 by the squeegee 44 so as to fully uncover the dots of colored, coagulated colloid adhered on the surface 32. Any non-coagulated colloid removed by the squeegee 44 is collected in the trough 114, mixed with excess colloidal dispersion in the reservoir 118 and the collected non-coagulated colloid in admixture with the excess colloidal dispersion is recirculated back to the device 38 by the pump 120, for discharge onto the positive electrode surface 32.

The optical density of the dots of colored, coagulated colloid may be varied by varying the voltage and/or pulse duration of the pulse-modulated signals applied to the negative electrodes 42. Synchronisation of the data furnished to the printing heads 40 is ensured by proper electronic circuitry (not shown).

The pressure rollers 46 which serve to bring the web 26 into contact with the dots of colored, coagulated colloid at the respective transfer stations are each in pressure contact engagement with the positive electrode 20 to form a nip 128 through which the web 26 is passed and permit the rollers 46 to be driven by the positive electrode 20 upon rotation thereof. As the web 26 is contacted with the dots of colored, coagulated colloid, the colored, coagulated colloid is transferred onto the web 26 to thereby imprint same with the image. The differently colored images produced by the printing units 22A, 22B, 22C and 22D are thus transferred onto the web 26 in superimposed relation to provide a polychromic image. Since a single positive electrode 20 is used and the web 26 contacts only the positive electrode surface 32 upon passing through the respective nip 128 of each transfer station, a polychromic image of high definition is obtained.

I claim:

1. A multicolor electrocoagulation printing method comprising the steps of:

a) providing a single positive electrode formed of an electrolytically inert metal and having a continuous passivated surface moving at substantially constant speed along a predetermined path, said passivated surface defining a positive electrode active surface;

b) forming on said positive electrode active surface a plurality of dots of colored, coagulated colloid by electrocoagulation of an electrolytically coagulable colloid in the presence of a coloring agent, said dots of colored, coagulated colloid being representative of a desired image;

c) bringing a substrate into contact with the dots of colored, coagulated colloid to cause transfer of the colored, coagulated colloid from the positive electrode active surface onto said substrate and thereby imprint said substrate with the image; and d) repeating steps (b) and (c) several times to define a corresponding number of printing stages arranged at predetermined locations along said path and each using a coloring agent of different color, and to thereby produce several differently colored images of coagulated colloid which are transferred at respective transfer positions onto said substrate in superimposed relation to provide a polychromic image.

2. A method as claimed in claim 1, wherein said positive electrode is a cylindrical electrode having a central longitudinal axis and rotating at substantially constant speed about said longitudinal axis, and wherein said printing stages are arranged around said positive cylindrical electrode.

3. A method as claimed in claim 2, wherein step (b) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap;

ii) coating the positive electrode active surface with an olefinic substance and a metal oxide to form on said surface micro-droplets of olefinic substance containing the metal oxide;

iii) filling said electrode gap with a substantially liquid colloidal dispersion containing said electrolytically coagulable colloid, said coloring agent, a liquid dispersing medium and a soluble electrolyte;

iv) electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming said dots of colored, coagulated colloid; and v) removing any remaining non-coagulated colloid from said positive electrode active surface.

4. A method as claimed in claim 3, wherein step (b) (ii) is carried out by providing a distribution roller extending parallel to said positive electrode and having a peripheral coating comprising an oxide ceramic material, applying said olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said olefinic substance in admixture with said metal oxide and having substantially uniform size and distribution, and transferring said micro-droplets from said ceramic coating onto said positive electrode active surface.

5. A method as claimed in claim 4, wherein said oxide ceramic material comprises a fused mixture of alumina and titania.

6. A method as claimed in claim 4, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, whereby said oily dispersion upon passing through said first nip forms said film uniformly covering the surface of said ceramic coating.

7. A method as claimed in claim 6, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

8. A method as claimed in claim 7, wherein said applicator roller and said transfer roller are each provided with a peripheral covering of a resilient material which is resistant to attack by said olefinic substance.

9. A method as claimed in claim 3, wherein step (b) (ii) is carried out by providing first and second distribution rollers extending parallel to said positive electrode and each having a peripheral coating comprising an oxide ceramic material, applying said olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said olefinic substance in admixture with said metal oxide and having substantially uniform size and distribution, transferring the at least partially broken film from said first distribution roller to said second distribution roller so as to cause said film to substantially completely break on the ceramic coating of said second distribution roller into said micro-droplets having substantially uniform size and distribution, and transferring said micro-droplets from the ceramic coating of said second distribution roller onto said positive electrode active surface.

10. A method as claimed in claim 9, wherein the ceramic coatings of said first distribution roller and said second distribution roller comprise the same oxide ceramic material, and wherein said oxide ceramic material comprises a fused mixture of alumina and titania.

11. A method as claimed in claim 9, wherein said oily dispersion is applied onto the ceramic coating of said first distribution roller by disposing an applicator roller parallel to said first distribution roller and in pressure contact engagement therewith to form a first nip, and rotating said applicator roller and said first distribution roller in register while feeding said oily dispersion into said first nip, whereby said oily dispersion upon passing through said first nip forms said film uniformly covering the surface of said ceramic coating.

12. A method as claimed in claim 11, wherein said at least partially broken film of oily dispersion is transferred from said first distribution roller to said second distribution roller and said micro-droplets are transferred from said second distribution roller to said positive electrode by disposing a first transfer roller between said first distribution roller and said second distribution roller in parallel relation thereto, positioning said first transfer roller in pressure contact engagement with said first distribution roller to form a second nip and in contact engagement with said second distribution roller to form a third nip, rotating said first distribution roller and said first transfer roller in register for transferring said at least partially broken film from said first distribution roller to said first transfer roller at said second nip, disposing a second transfer roller parallel to said second distribution roller and in pressure contact engagement therewith to form a fourth nip, positioning said second transfer roller in pressure contact engagement with said positive electrode to form a fifth nip, and rotating said second distribution roller, said second transfer roller and said positive electrode in register for transferring said at least partially broken film from said first transfer roller to said second distribution roller at said third nip, then transferring said micro-droplets from said second distribution roller to said second transfer roller at said fourth nip and thereafter transferring said micro-droplets from said second transfer roller to said positive electrode at said fifth nip.

13. A method as claimed in claim 12, wherein said applicator roller, said first transfer roller and said second transfer roller are each provided with a peripheral covering of a resilient material which is resistant to attack by said olefinic substance.

14. A method as claimed in claim 3, further including the step of polishing the olefin and metal oxide-coated positive electrode active surface to increase adherence of said micro-droplets onto said positive electrode active surface, prior to step (d) of each printing stage.

15. A method as claimed in claim 3, wherein said positive electrode extends vertically and wherein step (b) (iii) is carried out by continuously discharging said colloidal dispersion onto said positive electrode active surface from a fluid discharge means disposed adjacent said electrode gap at a predetermined height relative to said positive electrode and allowing said colloidal dispersion to flow downwardly along said positive electrode active surface, whereby said colloidal dispersion is carried by said positive electrode upon rotation thereof to said electrode gap to fill same.

16. A method as claimed in claim 15, further including the steps of collecting excess colloidal dispersion flowing downwardly off said positive electrode active surface and recirculating the collected colloidal dispersion back to said fluid discharge means.

17. A method as claimed in claim 16, further including the steps of collecting non-coagulated colloid removed from said positive electrode active surface in step (b) (v) of each printing stage, mixing the collected non-coagulated colloidal with the collected colloidal dispersion, and recirculating the collected colloidal dispersion in admixture with the collected non-coagulated colloid back to said fluid discharge means.

18. A method as claimed in claim 3, wherein said olefinic substance is selected from the group consisting of arachidonic acid, oleic acid, linoleic acid, linolenic acid, palmitoleic acid, corn oil, linseed oil, olive oil, peanut oil, soybean oil and sunflower oil, and wherein said metal oxide is selected from the group consisting of aluminum oxide, ceric oxide, chromium oxide, cupric oxide, magnesium oxide, manganese oxide, titanium dioxide and zinc oxide.

19. A method as claimed in claim 18, wherein said olefinic substance is oleic acid or linoleic acid and said metal oxide is chromium oxide.

20. A method as claimed in claim 2, wherein said substrate is in the form of a continuous web which is passed through said respective transfer positions for being imprinted with said colored images at said printing stages.

21. A method as claimed in claim 20, wherein step (c) is carried out by providing at each transfer position a pressure roller extending parallel to said positive electrode and in pressure contact engagement therewith to form a nip and permit said pressure roller to be driven by said positive electrode upon rotation thereof, and guiding said web so as to pass through said nip.

22. A method as claimed in claim 21, wherein there are at least two printing stages each including one said pressure roller and wherein said pressure rollers are arranged in pairs with the pressure rollers of each pair being diametrically opposed to one another.

23. A method as claimed in claim 1, further including the step of removing after step (c) of each printing stage any remaining coagulated colloid from said positive electrode active surface.

24. A method as claimed in claim 1, wherein said electrolytically inert metal is stainless steel or aluminum.

25. A multicolor electrocoagulation printing apparatus comprising:

a single positive electrode formed of an electrolytically inert metal and having a continuous passivated surface defining a positive electrode active surface;

means for moving said positive electrode active surface at a substantially constant speed along a predetermined path; and a plurality of printing units arranged at predetermined locations along said path, each printing unit comprising:

means for forming on said positive electrode active surface a plurality of dots of colored, coagulated colloid by electrocoagulation of an electrolytically coagulable colloid in the presence of a coloring agent of different color, said dots of colored, coagulated colloid being representative of a desired image; and means for bringing a substrate into contact with the dots of colored, coagulated colloid at a respective transfer station to cause transfer of the colored, coagulated colloid from the positive electrode active surface onto said substrate and thereby imprint said substrate with the image;

whereby to produce several differently colored images of coagulated colloid which are transferred at said respective transfer stations onto said substrate in superimposed relation to provide a polychromic image.

26. An apparatus as claimed in claim 25, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

27. An apparatus as claimed in claim 26, wherein said substrate is in the form of a continuous web and said means for bringing the web into contact with said dots of colored, coagulated colloid at said respective transfer station comprises a pressure roller extending parallel to said positive electrode and in pressure contact engagement therewith to form a nip and permit said pressure roller to be driven by said positive electrode upon rotation thereof, and means for guiding said web so as to pass through said nip.

28. An apparatus as claimed in claim 27, wherein there are at least two printing units each including one said pressure roller and wherein said pressure rollers are arranged in pairs with the pressure rollers of each pair being diametrically opposed to one another.

29. An apparatus as claimed in claim 25, wherein said means for forming said dots of colored, coagulated colloid comprises:

a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap;

means for coating the positive electrode active surface with an olefinic substance and a metal oxide to form on said surface micro-droplets of olefinic substance containing the metal oxide;

means for filling said electrode gap with a substantially liquid colloidal dispersion containing said electrolytically coagulable colloid, said coloring agent, a liquid dispersing medium and a soluble electrolyte;

means for electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming said dots of colored, coagulated colloid; and means for removing any remaining non-coagulated colloid from said positive electrode active surface.

30. An apparatus as claimed in claim 29, wherein said negative electrodes are arranged in an elongated head along the length thereof, said head having a longitudinal axis and being pivotally movable about a pivot axis extending parallel to the longitudinal axis of said head for moving said negative electrode between a first position whereat said negative electrode active surfaces are spaced from said positive electrode active surface by said constant predetermined gap and a second position whereat said negative electrode active surfaces are exposed to permit cleaning thereof.

31. An apparatus as claimed in claim 29, wherein said means for coating said positive electrode active surface comprises a distribution roller extending in spaced-apart parallel relation to said positive electrode, said distribution roller having a peripheral coating comprising an oxide ceramic material, applicator means for applying said olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said olefinic substance in admixture with said metal oxide and having substantially uniform size and distribution, and transfer means arranged between said distribution roller and said positive electrode for transferring said micro-droplets from said ceramic coating onto said positive electrode active surface.

32. An apparatus as claimed in claim 31, wherein said oxide ceramic material comprises a fused mixture of alumina and titania.

33. An apparatus as claimed in claim 31, wherein said applicator means comprise an applicator roller extending parallel to said distribution roller and in pressure contact engagement therewith to form a first nip, means rotating said applicator roller and said distribution roller in register and feed means for feeding said oily dispersion into said first nip, whereby said oily dispersion upon passing through said first nip forms said film uniformly covering the surface of said ceramic coating.

34. An apparatus as claimed in claim 33, wherein said transfer means comprises a transfer roller extending parallel to said distribution roller and in contact engagement therewith to form a second nip, said transfer roller being in pressure contact engagement with said positive electrode to form a third nip and permit said transfer roller to be driven by said positive electrode upon rotation thereof, whereby said micro-droplets are transferred from said distribution roller to said transfer roller at said second nip and thereafter from said transfer roller to said positive electrode at said third nip.

35. An apparatus as claimed in claim 34, wherein said applicator roller and said transfer roller are each provided with a peripheral covering of a resilient material which is resistant to attack by said olefinic substance.

36. An apparatus as claimed in claim 29, wherein said means for coating said positive electrode surface comprises first and second distribution rollers arranged in spaced-apart parallel relation to one another and to said positive electrode, said first and second distribution rollers each having a peripheral coating comprising an oxide ceramic material, applicator means for applying said olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said olefinic substance in admixture with said metal oxide and having substantially uniform size and distribution, first transfer means arranged between said first distribution roller and said second distribution roller for transferring the at least partially broken film from said first distribution to said second distribution roller so as to cause said film to substantially completely break on the ceramic coating of said second distribution roller into said micro-droplets having a substantially uniform size and distribution, and second transfer means arranged between said second distribution roller and said positive electrode for transferring said micro-droplets from the ceramic coating of said second distribution roller onto said positive electrode active surface.

37. An apparatus as claimed in claim 36, wherein the ceramic coatings of said first distribution roller and said second distribution roller comprise the same oxide ceramic material, and wherein said oxide ceramic material comprises a fused mixture of alumina and titania.

38. An apparatus as claimed in claim 36, wherein said applicator means comprise an applicator roller extending parallel to said first distribution roller and in pressure contact engagement therewith to form a first nip, means rotating said applicator roller and said first distribution roller in register and feed means for feeding said oily dispersion into said first nip, whereby said oily dispersion upon passing through said first nip forms said film uniformly covering the surface of said ceramic coating.

39. An apparatus as claimed in claim 38, wherein said first transfer means comprises a first transfer roller extending parallel to said first and second distribution rollers and in pressure contact engagement with said first distribution roller to form a second nip and permit said first transfer roller to be driven by said first distribution roller upon rotation thereof, said first transfer roller being in contact engagement with said second distribution roller to form a third nip, whereby said at least partially broken film is transferred from said first distribution roller to said transfer roller at said second nip and thereafter from said first transfer roller to said second distribution roller at said third nip.

40. An apparatus as claimed in claim 39, wherein said second transfer means comprises a second transfer roller extending parallel to said second distribution roller and in pressure contact engagement therewith to form a fourth nip, said second transfer roller being in pressure contact engagement with said positive electrode to form a fifth nip and permit said second transfer roller to be driven by said positive electrode and said second distribution roller to be driven by said second transfer roller upon rotation of said positive electrode, whereby said micro-droplets are transferred from said second distribution roller to said second transfer roller at said fourth nip and thereafter from said second transfer roller to said positive electrode at said fifth nip.

41. An apparatus as claimed in claim 40, wherein said applicator roller, said first transfer roller and said second transfer roller are each provided with a peripheral covering of a resilient material which is resistant to attack by said olefinic substance.

42. An apparatus as claimed in claim 40, wherein each said printing unit further includes means for polishing the olefin and metal oxide-coated positive electrode active surface to increase adherence of said micro-droplets onto said positive electrode active surface, prior to filling said electrode gap with said colloidal dispersion.

43. An apparatus as claimed in claim 29, wherein said positive electrode extends vertically and wherein said means for filling said electrode gap with said colloidal dispersion comprises fluid discharge means disposed adjacent said electrode gap and at a predetermined height relative to said positive electrode for continuously discharging said colloidal dispersion onto said positive electrode active surface, whereby said colloidal dispersion flows downwardly along said positive electrode active surface and is carried by said positive electrode upon rotation thereof to said electrode gap to fill same.

44. An apparatus as claimed in claim 43, wherein each said printing station further includes means for collecting excess colloidal dispersion flowing downwardly off said positive electrode active surface, and means for recirculating the collected colloidal dispersion back to said fluid discharge means.

45. An apparatus as claimed in claim 44, wherein each said printing station further includes means for collecting non-coagulated colloid removed from said positive electrode active surface by said removing means and means for mixing the collected non-coagulated colloid with the collected colloidal dispersion, and wherein said recirculating means is operative to recirculate the collected colloidal dispersion in admixture with the collected non-coagulated colloid back to said fluid discharge means.

46. An apparatus as claimed in claim 29, wherein said olefinic substance is selected from the group consisting of arachidonic acid, oleic acid, linoleic acid, linolenic acid, palmitoleic acid, corn oil, linseed oil, olive oil, peanut oil, soybean oil and sunflower oil, and wherein said metal oxide is selected from the group consisting of aluminum oxide, ceric oxide, chromium oxide, cupric oxide, magnesium oxide, manganese oxide, titanium dioxide and zinc oxide.

47. An apparatus as claimed in claim 46, wherein said olefinic substance is oleic acid or linoleic acid and said metal oxide is chromium oxide.

48. An apparatus as claimed in claim 25, wherein each said printing station further includes means for removing any remaining coagulated colloid from said positive electrode active surface after transfer of said dots of colored, coagulated colloid onto said substrate.

49. An apparatus as claimed in claim 25, wherein said electrolytically inert metal is stainless steel or aluminum.

* * * * *

UNITED STATES PATENT AND TRADEMARK OFFICE

CERTIFICATE OF CORRECTION

PATENT NO. : 5,538,601

DATED : July 23, 1996

INVENTOR(S) : Adrien Castegnier

It is certified that error appears in the above-identified patent and that said Letters Patent is hereby corrected as shown below:

Title page,
Column 1, line 1 and title page, item 54, before "Electrocoagulation" insert --Multicolor--, and before "and" insert --Method--.

Signed and Sealed this

Twenty-third Day of September, 1997

Bruce Lehman

*Attest:*

BRUCE LEHMAN

*Attesting Officer*

*Commissioner of Patents and Trademarks*